US012312207B2

(12) United States Patent
Poo

(10) Patent No.: US 12,312,207 B2
(45) Date of Patent: May 27, 2025

(54) APPARATUS FOR WINDING CABLES

(71) Applicant: Javier Ruiz Poo, Mexico City (MX)

(72) Inventor: Javier Ruiz Poo, Mexico City (MX)

( * ) Notice: Subject to any disclaimer, the term of this patent is extended or adjusted under 35 U.S.C. 154(b) by 149 days.

(21) Appl. No.: 17/952,114

(22) Filed: Sep. 23, 2022

(65) Prior Publication Data

US 2023/0098936 A1 Mar. 30, 2023

Related U.S. Application Data

(60) Provisional application No. 63/247,985, filed on Sep. 24, 2021.

(51) Int. Cl.
*B65H 75/44* (2006.01)

(52) U.S. Cl.
CPC ..... *B65H 75/44* (2013.01)

(58) Field of Classification Search
CPC ..... B65H 75/44; B65H 2701/3919; B65H 75/4471; B65H 75/4473; B65H 75/446
USPC ..... 242/601
See application file for complete search history.

(56) References Cited

U.S. PATENT DOCUMENTS

| | | | | | |
|---|---|---|---|---|---|
| 1,493,381 | A * | 5/1924 | Phelps | B65H 75/141 | 206/400 |
| 2,429,675 | A * | 10/1947 | Eypper | H02G 11/02 | 242/601 |
| 2,865,071 | A * | 12/1958 | Clemens | H02G 11/02 | 242/601 |
| 2,991,523 | A * | 7/1961 | Del Conte | H02G 11/02 | 242/601 |
| 3,212,729 | A * | 10/1965 | Putnam | B65H 75/16 | 242/129 |
| 8,091,820 | B2 * | 1/2012 | Thorn | B65H 75/2272 | 242/405 |
| 9,908,742 | B2 * | 3/2018 | Mertesdorf | B65H 75/4471 | |
| 11,437,802 | B2 * | 9/2022 | Bailey | H02G 11/02 | |

* cited by examiner

*Primary Examiner* — William A. Rivera
(74) *Attorney, Agent, or Firm* — Procopio, Cory, Hargreaves & Savitch LLP

(57) ABSTRACT

An apparatus for winding at least one cable includes a cover, a top portion attached to the cover, and a base attached to the top portion. A surface of the base is configured to be attached to a stationary object. The top portion includes a sloped surface configured to receive the at least one cable, such that the at least one cable remains detangled and is externally invisible when is fully wound around the sloped surface.

18 Claims, 17 Drawing Sheets

APPARATUS FOR WINDING CABLES

BACKGROUND

Field

Aspects of the example implementations relate to an apparatus for winding cables, and more specifically, an apparatus configured to wind a cable within an integrated apparatus, with the cables being wound in an ordered manner so that cables of multiple devices are not interwoven with each other.

Related Art

Related art cables, such as for electronics on a desk in a commercial or residential setting, are typically connected directly from the electronic device to an outlet, sometimes via a conduit or an aperture in the desk. Thus, when multiple electronics devices are used in a setting such as a student desk or an office desk, the wires of different electronic devices may become entangled with one another. Thus, it becomes difficult for a user to remove one or more electronic cables, such as when removing a charger and charging wire for travel with a mobile device, installing a new electronic device, removing or deprecating an old electronic device, etc. Further, the related art approach results in a messy, tangled arrangement of the cables, which takes effort and time of the user to organize. Further, some related art users may not be able to easily reach such cables, due to physical injury or limitation, or due to the configuration or location of the desk.

Summary of the Disclosure

Aspects of the example implementations address at least the foregoing related issues. More specifically, an apparatus is provided that includes a curved surface that can accept one or more cables to be rolled or wound thereon, such that the one or more cables are wound and organized independently of one another.

According to an aspect, an apparatus is provided for winding at least one cable includes a cover, a top portion attached to the cover, and a base attached to the top portion. A surface of the base is configured to be attached to a stationary object. The top portion includes a sloped surface configured to receive the at least one cable, such that the at least one cable remains detangled from one another and are externally invisible when are fully wound around the sloped surface.

According to another aspect, a stationary object is provided that includes an apparatus for winding at least one cable, and a platform on which the apparatus is attached. The apparatus includes a cover, a top portion attached to the cover, and a base attached to the top portion. A surface of the base is configured to be attached to the platform, and the top portion includes a sloped surface configured to receive the one or more cables, such that at least one cable remains detangled and is externally invisible when are fully wound around the sloped surface.

BRIEF DESCRIPTION OF THE DRAWINGS

A general architecture that implements the various features of the disclosure will now be described with reference to the drawings. The drawings and the associated descriptions are provided to illustrate example implementations of the disclosure and not to limit the scope of the disclosure. Throughout the drawings, reference numbers are reused to indicate correspondence between referenced elements.

DETAILED DESCRIPTION

Figure 1:
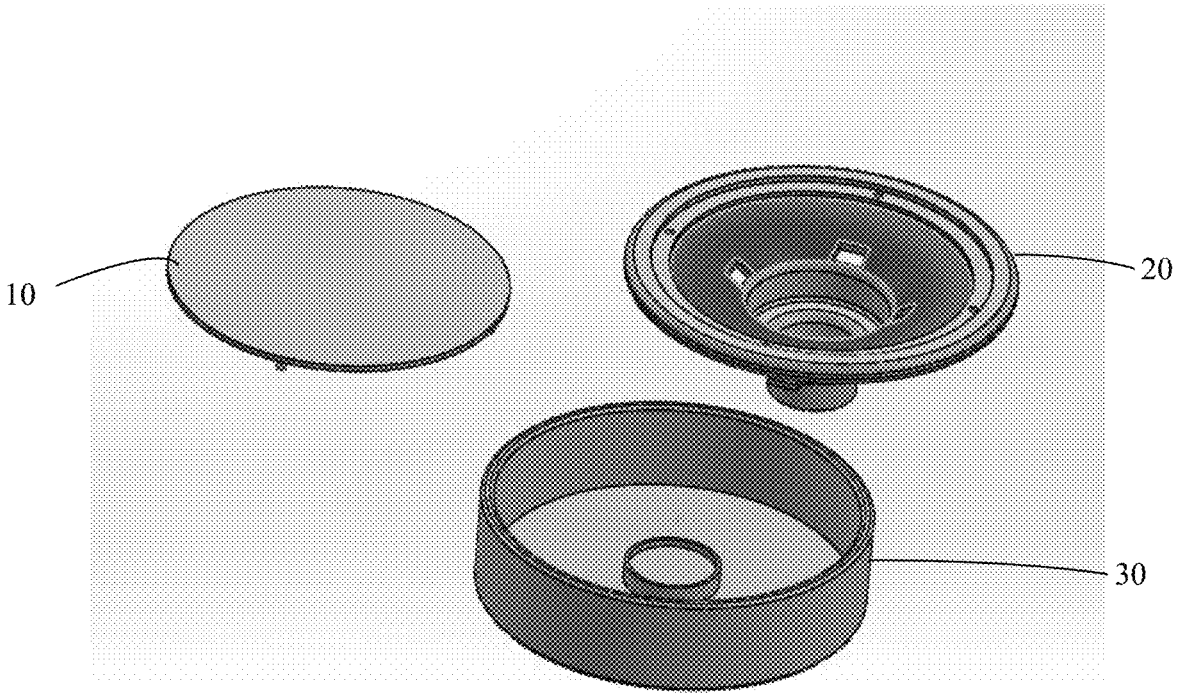
FIG. 1 illustrates an example of components of an apparatus for winding cables in accordance with an example implementation associated with the inventive concept.

The following detailed description provides further details of the figures and example implementations of the present application. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or operator control over certain aspects of the implementation, depending on the desired implementation of one of ordinary skill in the art practicing implementations of the present application. Further, sequential terminology, such as "first", "second", "third", etc., may be used in the description and claims simply for labeling purposes and should not be limited to referring to described actions or items occurring in the described sequence. Actions or items may be ordered into a different sequence or may be performed in parallel or dynamically, without departing from the scope of the present application.

As can be seen from the drawings, the apparatus according to the example implementations is designed to organize the accumulation of one or more cables. The cables may remain in an organized state with respect to one another, independent of the size (e.g., length, diameter, density and/or mass) of the cables, the usage with different devices, or the like. The example implementations may be employed in various settings, including but not limited to home, industry, retail, commercial or others.

FIG. 1 illustrates an example of components of an unassembled apparatus for winding cables in accordance with an example implementation associated with the inventive concept.

The apparatus includes a cover 10, a top portion 20 attached to the cover 10, and a base 30 attached to the top portion 20.

A bottom surface of the base 30 is configured to be attached to a stationary object. The top portion 20 includes a sloped surface configured to receive at least one cable, such that the at least one cable remains detangled and is externally invisible when are fully wound around the sloped surface.

In an exemplary embodiment, the bottom surface of the base 30 is configured to be fixably or permanently attached to a stationary object.

In another exemplary embodiment, the bottom surface of the base 30 is configured to be detachably attached to the stationary object.

The detachable attachment of the bottom surface of the base 30 the stationary object may be arranged by an adhesive, a tape, such as a double-side tape, Velcro®, female and male connections such as screws/bolts and nuts, etc.

In an exemplary embodiment, the top portion 20 is detachably attached to the cover 10.

In another exemplary embodiment, the cover 10 and top portion 20 are a unitary piece that attaches to the base 30.

Figure 2:
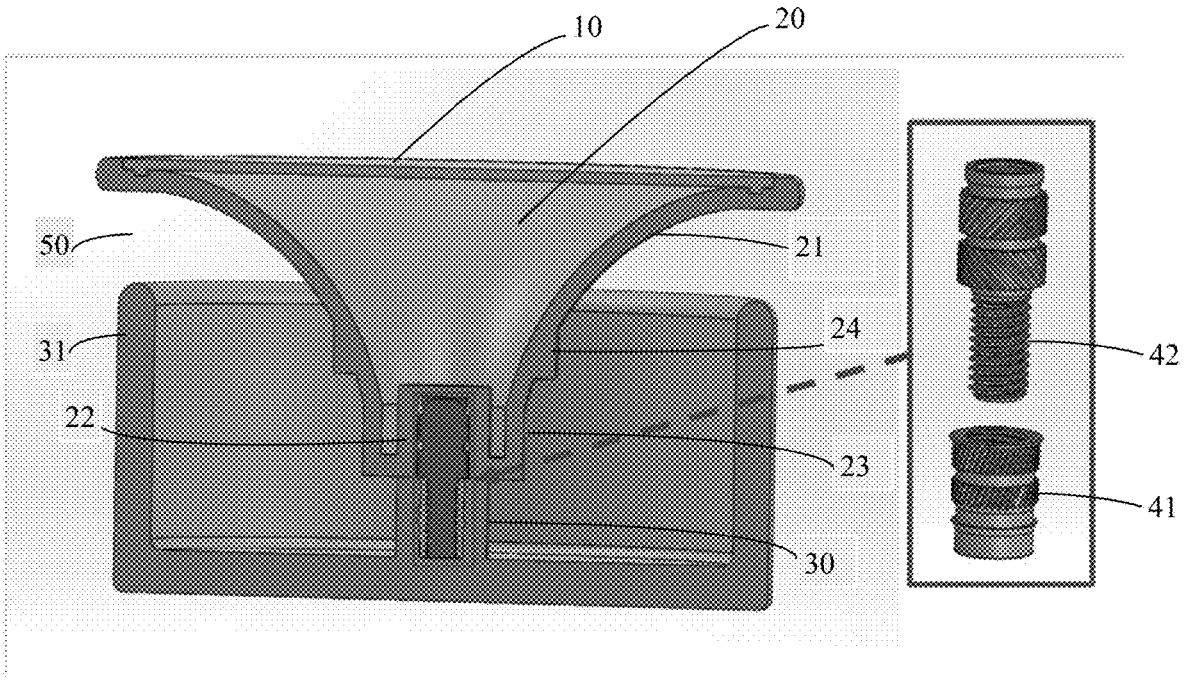
FIG. 2 illustrates a cross-sectional view of an example of an apparatus for winding cables in accordance with an example implementation associated with the inventive concept.

FIG. 2 illustrates a cross-sectional view of an example of an assembled apparatus for winding cables in accordance with an example implementation associated with the inventive concept, showing more details of the components demonstrated in FIG. 1.

As shown in FIG. 2, the base 30 includes a cylindrical enclosure 31 that extends from a bottom surface of the base 30.

The top portion 20 rotates around an axial direction of the cylindrical enclosure 31 to change a gap 50 between a top surface of the cylindrical enclosure 31 and a bottom surface of the cover 10.

The one or more cables passes through the gap 50 to wind around sloped surface 21 of the top portion 20.

After the at least one cable is wound around the sloped surface 21, the at least one cable exits the apparatus through the gap 50.

One of the top portion 20 and the base 30 includes a female connector 41 configured to engage with a male connector 42 provided in an other one of the top portion 20 and the base 30.

By engaging the female connector 41 to the male connector 42, the gap 50 between a top surface of the base 30 and a bottom surface of the cover 10 changes to provide a space for the at least one cable to pass through the gap 50 for winding around the sloped surface 21.

The male connector 42 may include a bolt and the female connector 41 may include a nut that engages with bolt by rotating the top portion 20 around an axial direction of the bolt to change the gap 50 between a top surface of the base 30 and a bottom surface of the cover 10 to provide a space for the at least one cable to pass through the gap 50 for winding around the sloped surface 21.

The top portion 20 may include a cylindrical body 22 that extends from a bottom surface of the top portion 20 toward the cover 10.

The sloped surface 21 protrudes in a radial direction of cylindrical body 22 and from a side surface of the cylindrical body 22 toward to a bottom surface of the cover 10.

The sloped surface 21 includes a plurality of protrusions 23 each protruding in the radial direction of cylindrical body 22 and extending from a side surface of the cylindrical body 22 to the bottom surface of the cover 10.

An inner surface of each of the protrusions 23 is attached to the cylindrical body 22 and the bottom surface of the cover 10.

An outer surface of each of the protrusions 23 is configured to contact the at least one cable while the at least one cable winds around the sloped surface 21.

In an exemplary embodiment, a pair of bumps 24 protrudes in the radial direction of cylindrical body 22 and from the side surface of the cylindrical body 22.

In the radial direction of cylindrical body 22, the pair of bumps 24 protrudes more than each of the protrusions 23.

An inner surface of each of the bumps 24 is attached to the cylindrical body 22 and the bottom surface of the cover 10.

An outer surface of each of the protrusions 23 is configured to contact the at least one cable while the at least one cable winds around the sloped surface 21.

In another exemplary embodiment, a stationary object includes the apparatus shown in FIGS. 1 and 2 for winding at least one cable, and a platform on which the apparatus is attached.

As set forth above and shown in FIGS. 1 and 2, the apparatus includes a cover 10, a top portion 20 attached to the cover 10, and a base 30 attached to the top portion 20.

A surface of the base 30 is configured to be attached to the platform.

The top portion 20 includes a sloped surface 21 configured to receive the at least one cable, such that at least one cable remains detangled and is externally invisible when is fully wound around the sloped surface 21.

Figure 3:
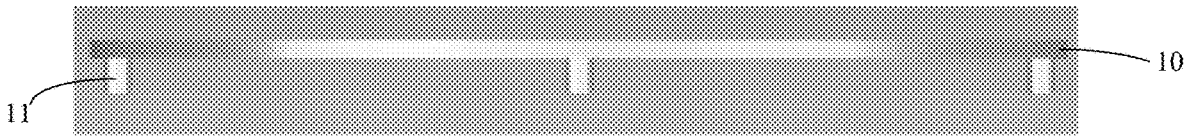
FIG. 3 illustrates a side view of the cover of the apparatus for winding cables according to an example implementation.

FIG. 3 illustrates a side view of the cover 10 of the assembly according to an example implementation. Cover 10 may include legs 11 for insertion into the top portion.

Figure 4:
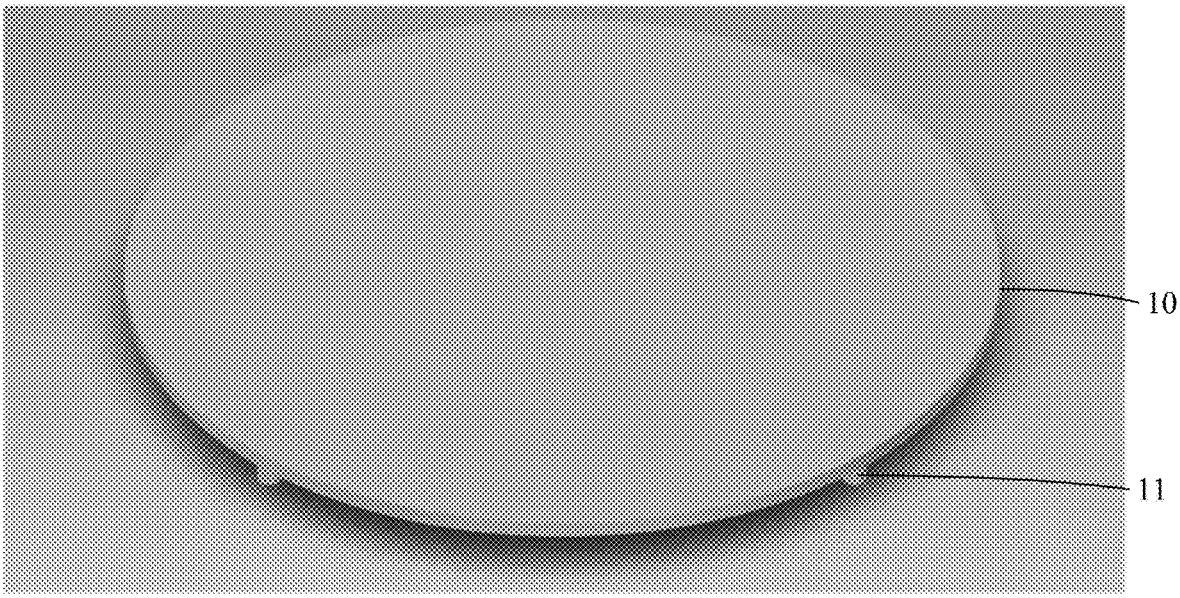
FIG. 4 illustrates a front view of the cover of the apparatus for winding cables according to an example implementation.
Figure 5:
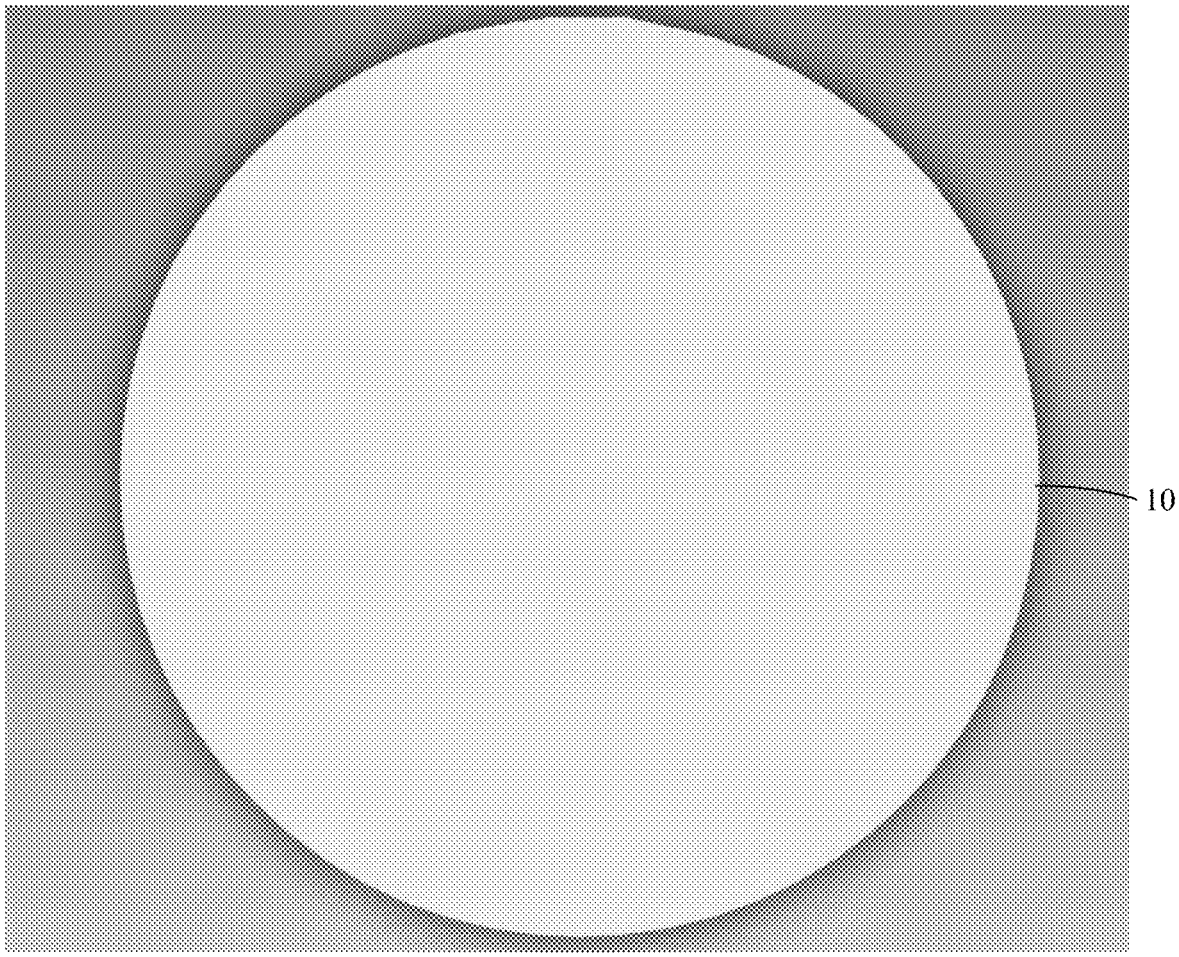
FIG. 5 illustrates a top view of the cover of the apparatus for winding cables according to an example implementation.

FIG. 4 illustrates a front view of the cover 10 of the assembly according to an example implementation, and FIG. 5 illustrates a top view of the cover 10 of the assembly according to an example implementation.

Figure 6:
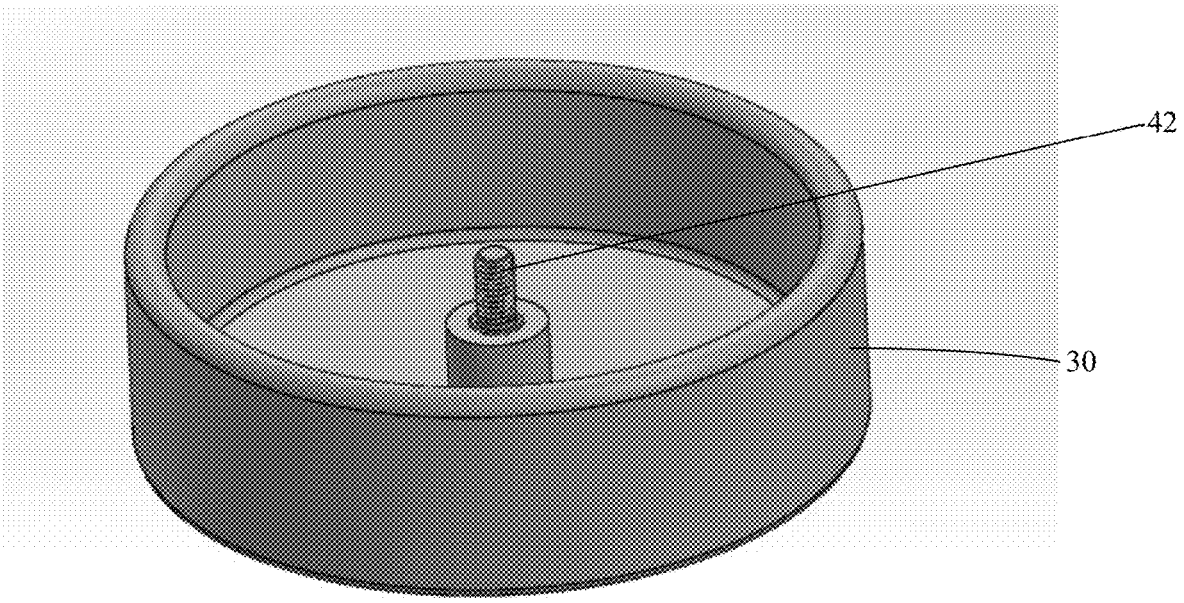
FIG. 6 illustrates a front view of the base of the apparatus for winding cables according to an example implementation.

FIG. 6 illustrates a front view of the base 30 of the assembly according to an example implementation.

The base 30 may include male connector 42, as shown in FIG. 2. In an exemplary aspect, the male connected may include a bolt or a screw to be inserted into a female connector of the top portion 20.

Figure 7:
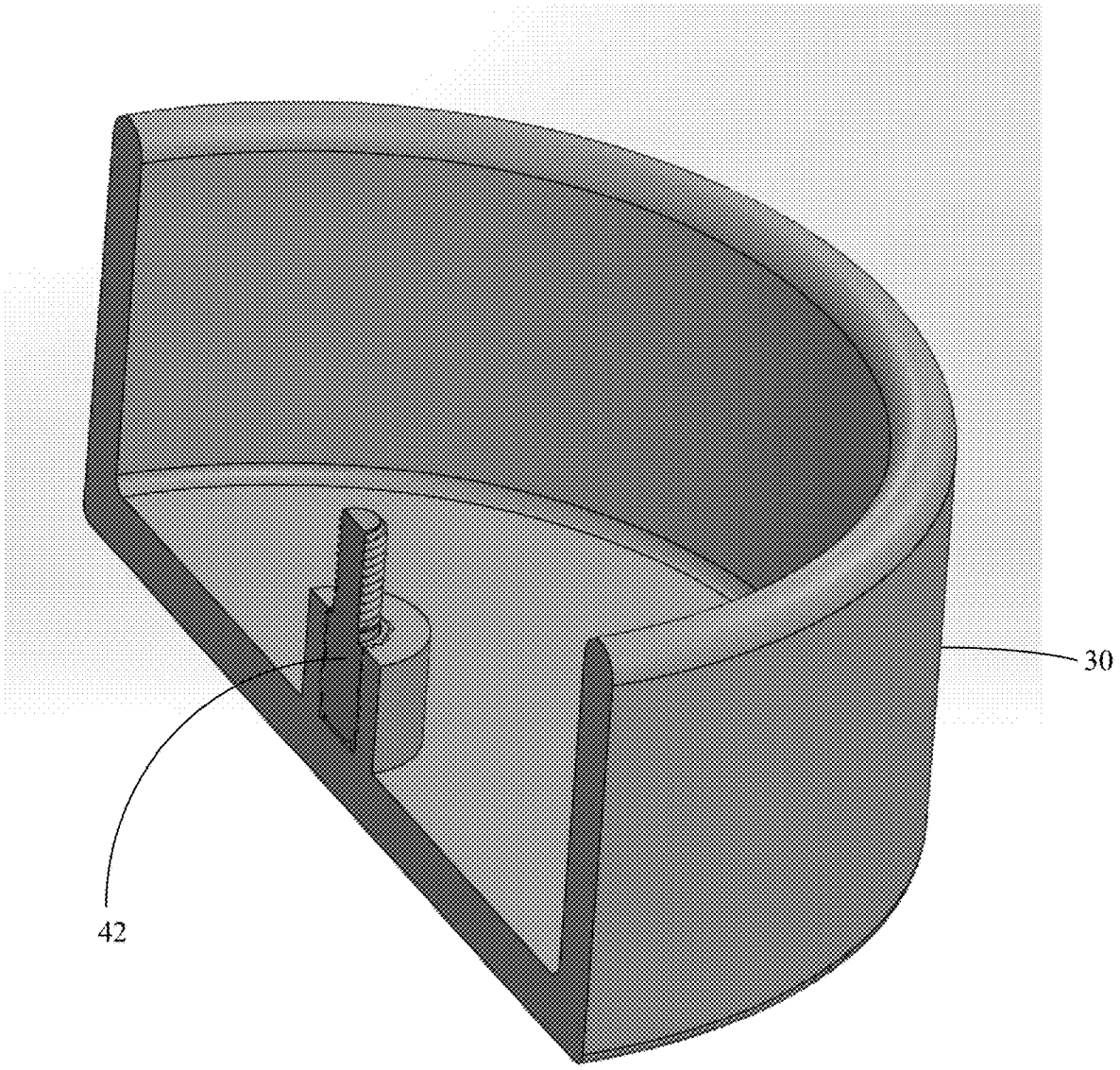
FIG. 7 illustrates a cut-out view of the base of the apparatus for winding cables according to an example implementation.

FIG. 7 illustrates a cut-out view of the base 30 of the assembly that includes the male connector 42.

Figure 8:
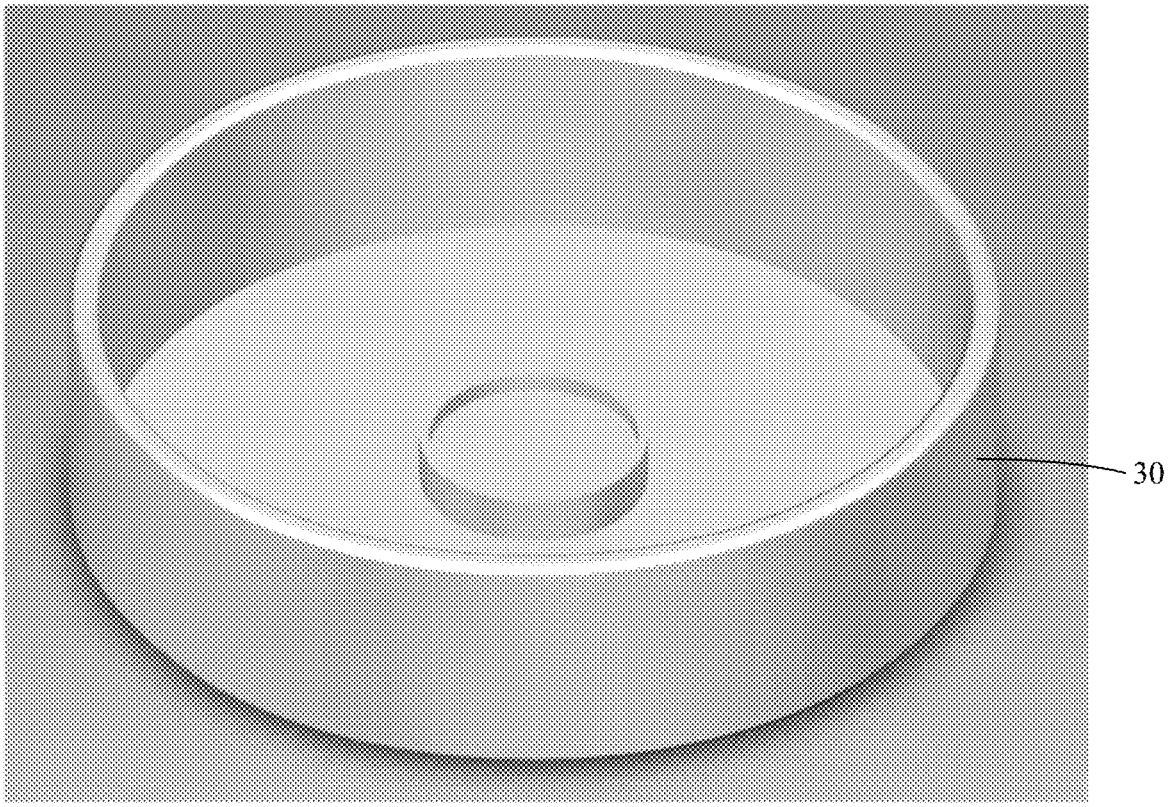
FIG. 8 illustrates a front view of the base of the apparatus for winding cables according to another example implementation.

FIG. 8 illustrates a front view of the base 30 of the assembly according to another example implementation.

Figure 9:
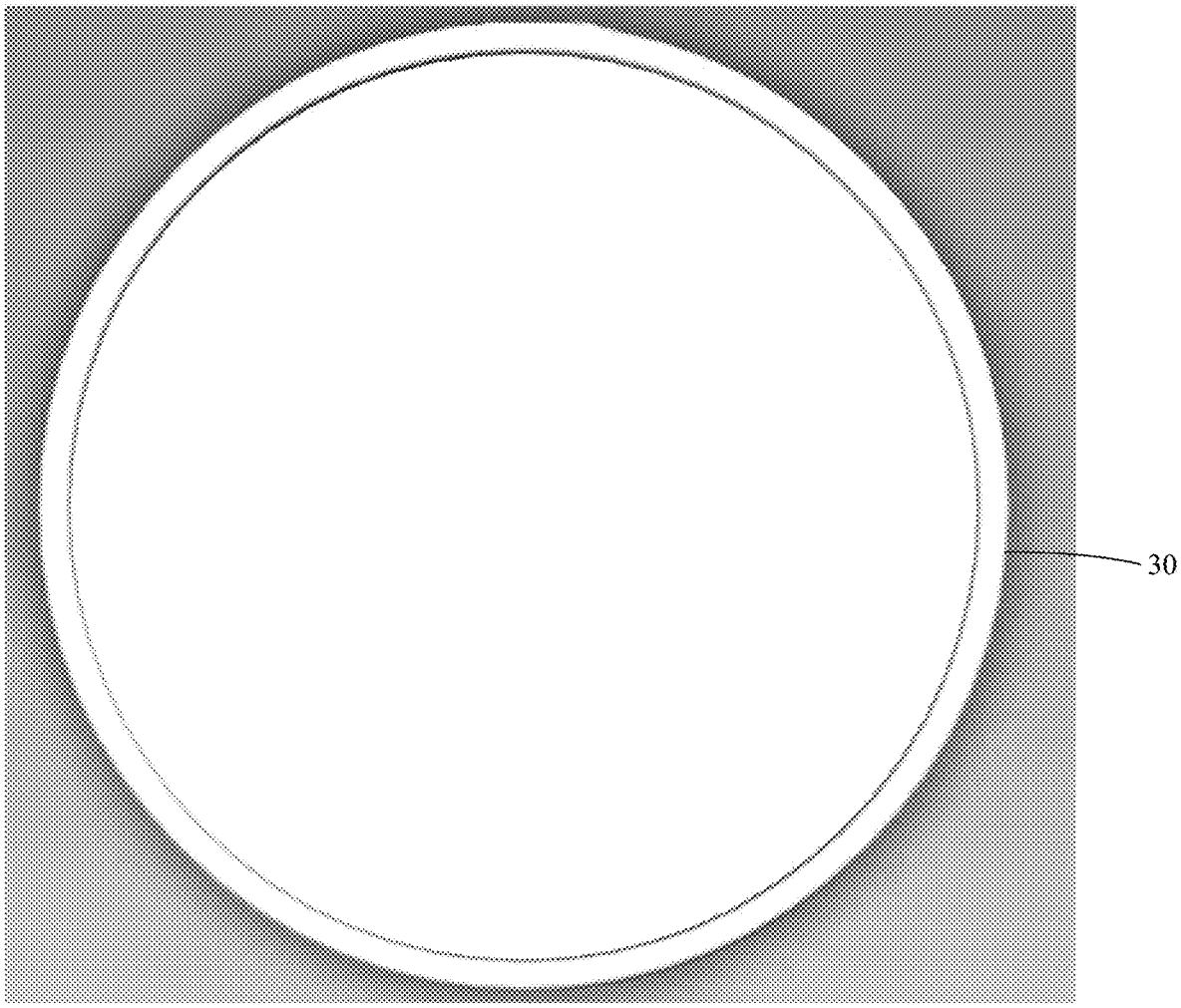
FIG. 9 illustrates a top view of the base of the apparatus for winding cables according to an example implementation.

FIG. 9 illustrates a top view of the base 30 of the assembly according to an example implementation.

Figure 10:
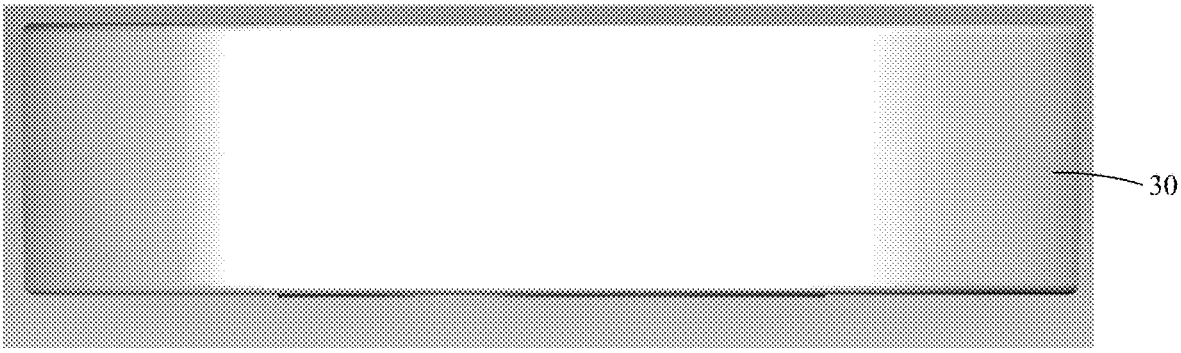
FIG. 10 illustrates a side view of the base of the apparatus for winding cables according to an example implementation.

FIG. 10 illustrates a side view of the base 30 of the assembly according to an example implementation.

Figure 11:
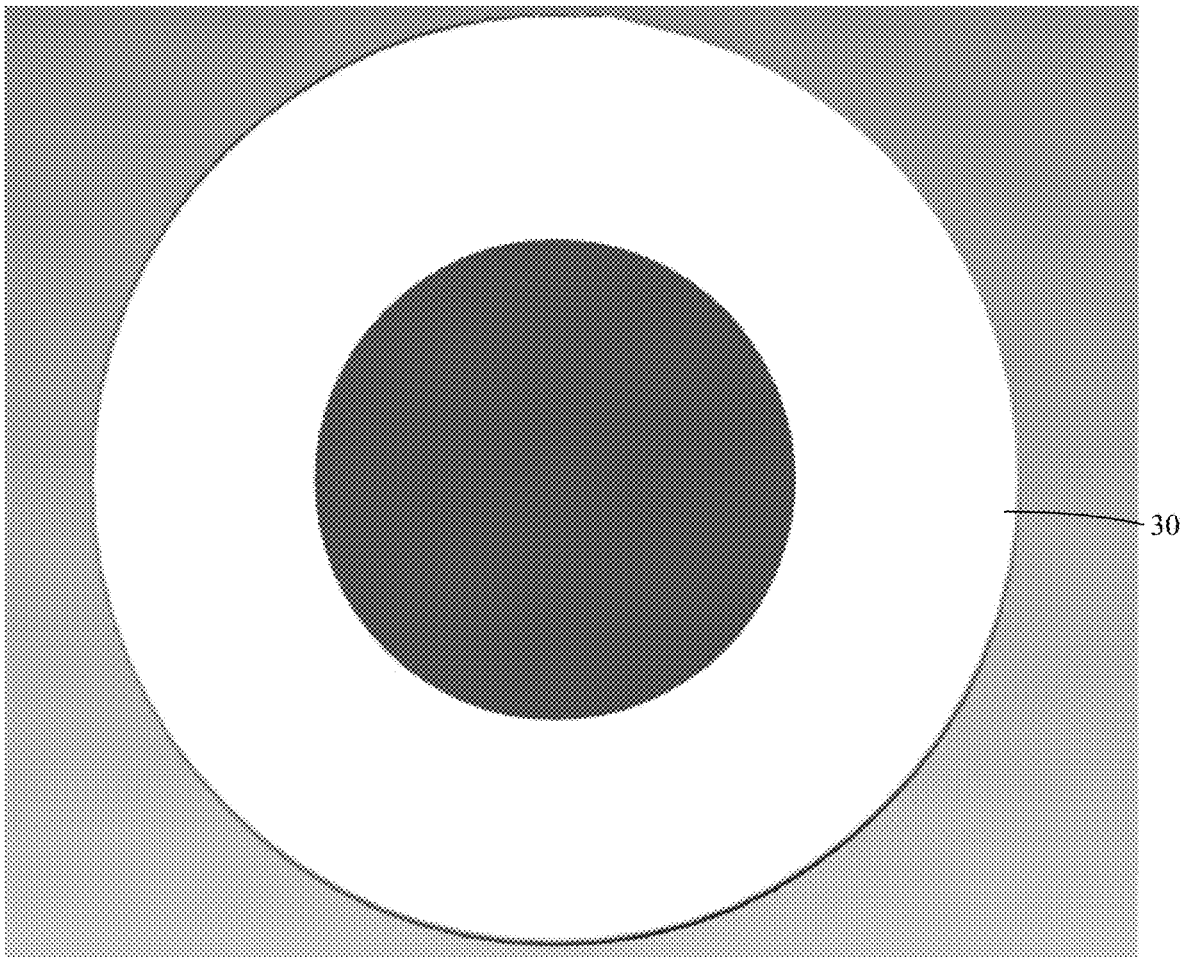
FIG. 11 illustrates a top view of the base of the apparatus for winding cables according to another example implementation.

FIG. 11 illustrates a top view of the base 30 of the assembly according to another example implementation.

Figure 12:
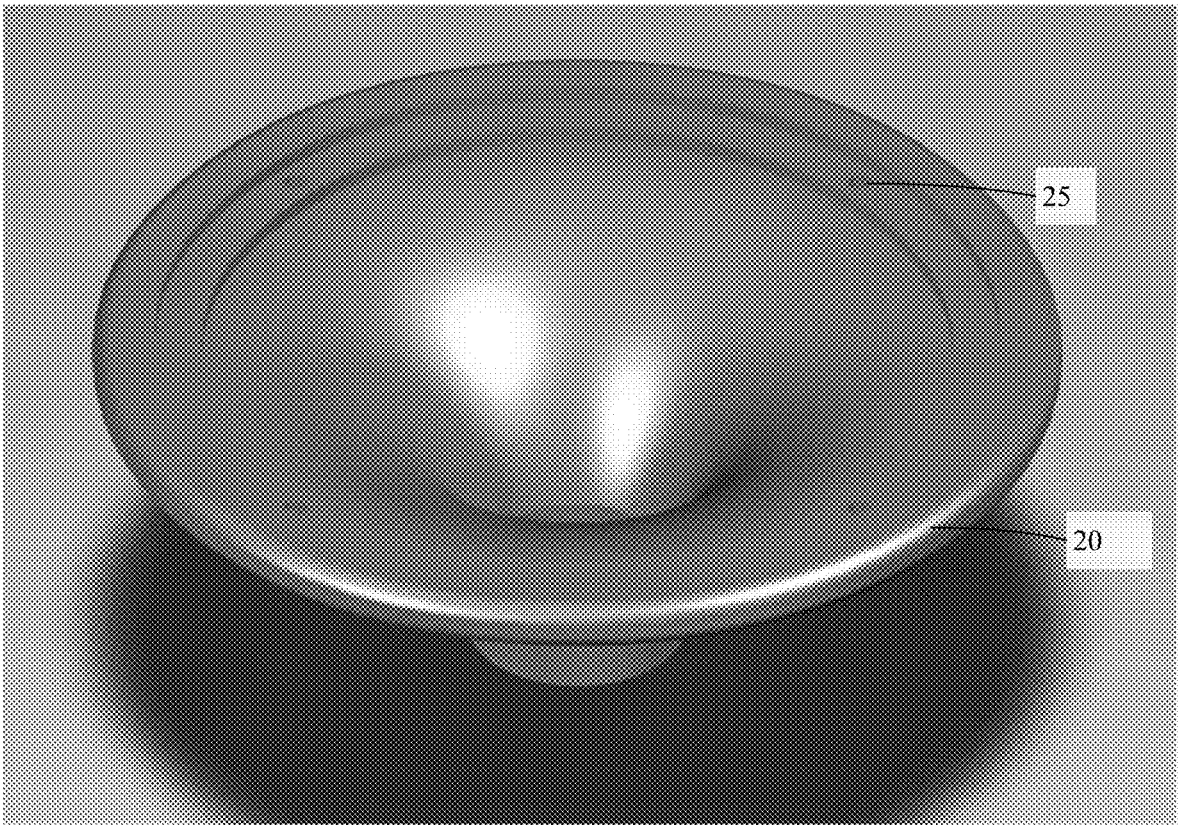
FIG. 12 illustrates a front view of the top portion of the apparatus for winding cables according to an example implementation.

FIG. 12 illustrates a front view of the top portion 20 of the assembly according to an example implementation.

An upper surface of the top portion 20 may include indentations 25 for inserting legs 11 of the cover shown in FIGS. 3 and 4.

Figure 13:
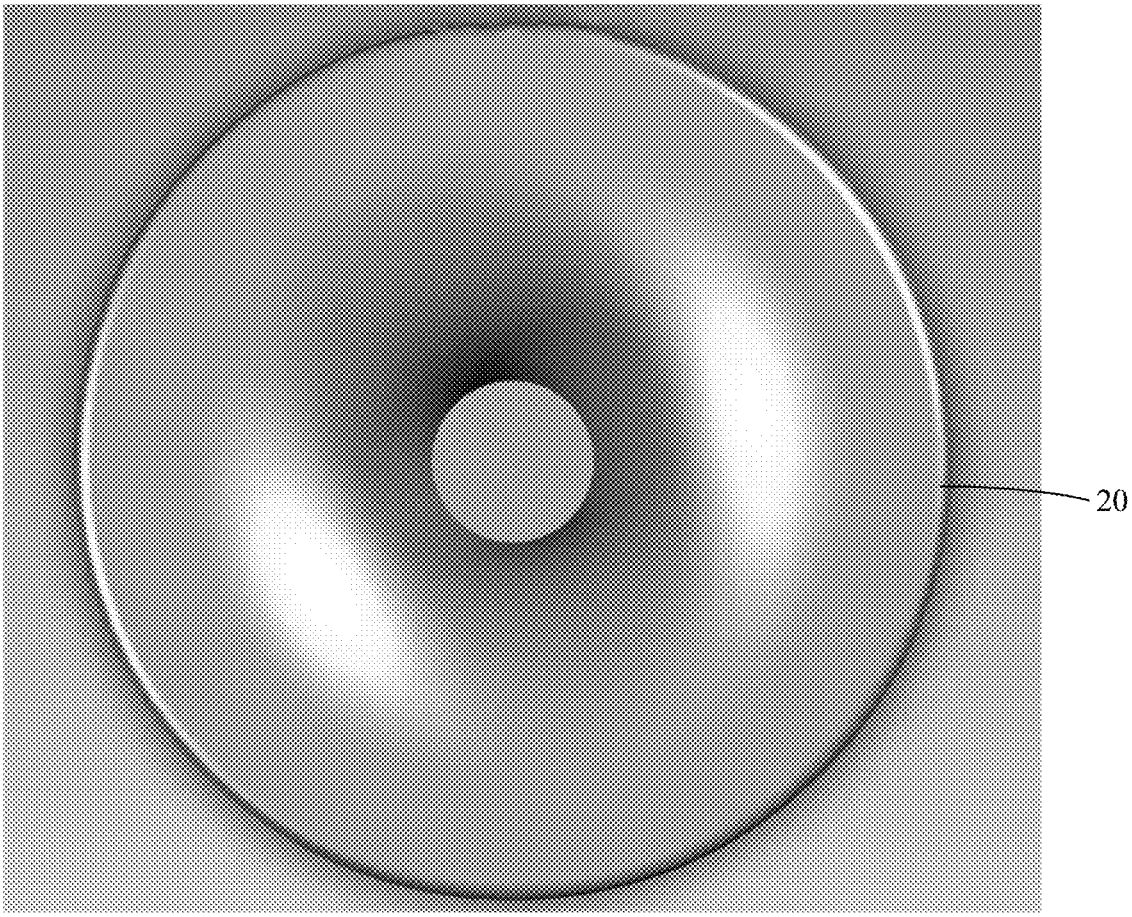
FIG. 13 illustrates a top view of the top portion of the apparatus for winding cables according to an example implementation.

FIG. 13 illustrates a top view of the top portion 20 of the assembly according to an example implementation.

Figure 14:
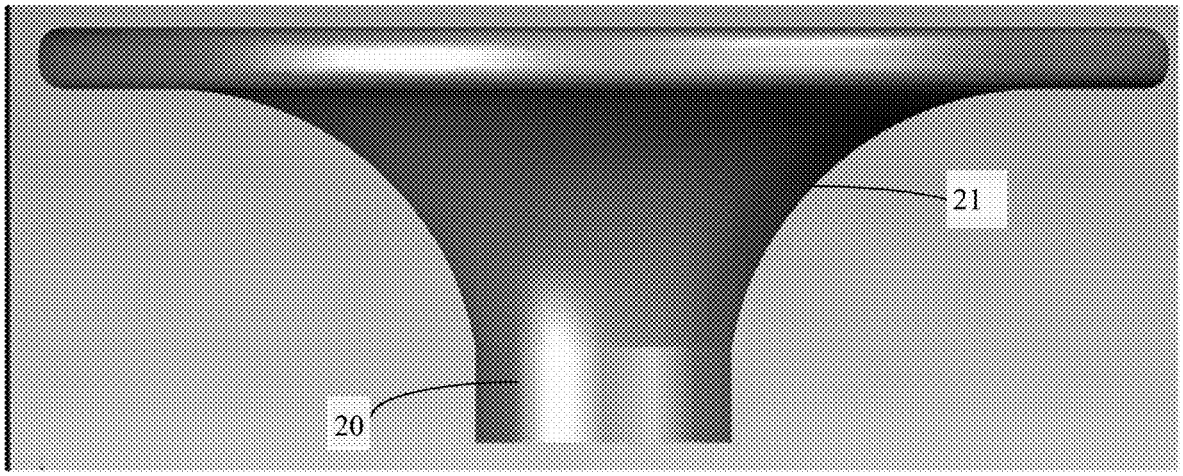
FIG. 14 illustrates a side view of the top portion of the apparatus for winding cables according to an example implementation.

FIG. 14 illustrates a side view of the top portion 20 of the assembly including the sloped surface 21, which is curved, according to an example implementation.

Figure 15:
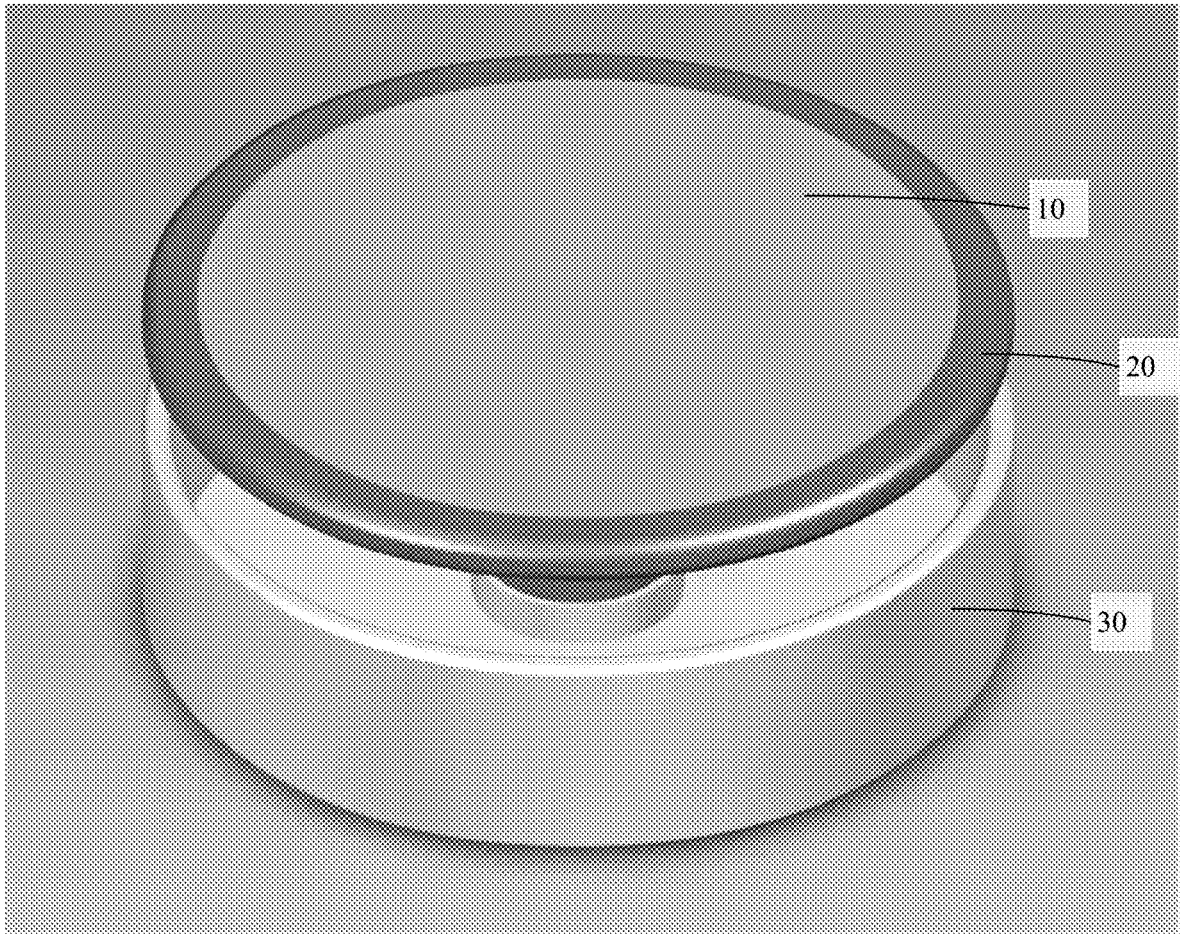
FIG. 15 illustrates a front view of the apparatus for winding cables according to an example implementation.

FIG. 15 illustrates a front view of the apparatus for winding cables, including cover 10, top portion 20, and base 30, according to an example implementation.

Figure 16:
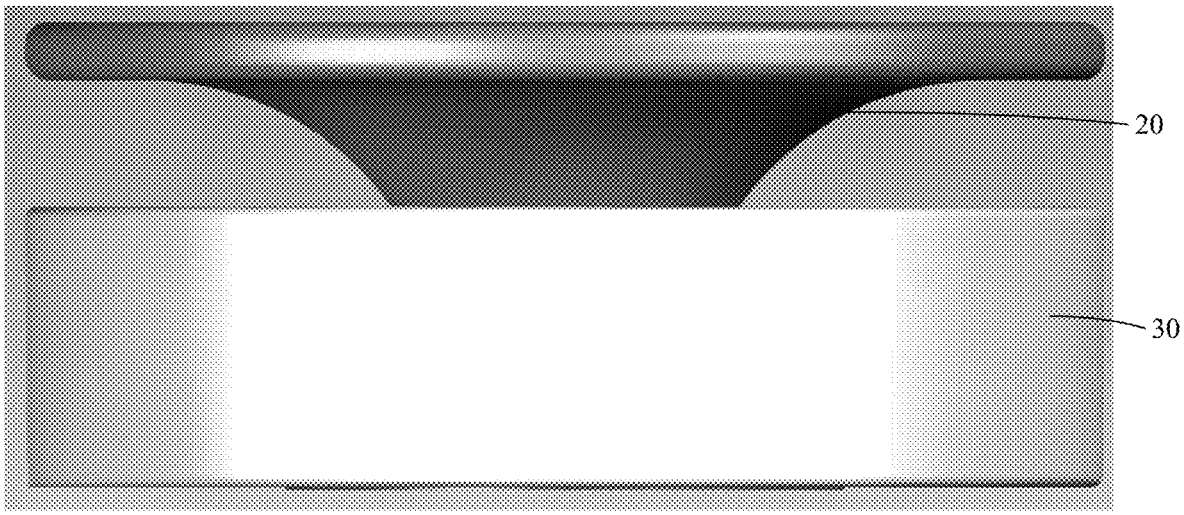
FIG. 16 illustrates a side view of the apparatus for winding cables according to an example implementation.

FIG. 16 illustrates a side view of the apparatus for winding cables, including top portion 20 and base 30, according to an example implementation.

The cover 10 and top portion 20 may be integrally formed together as unitary piece that attaches to the base 30.

Figure 17:
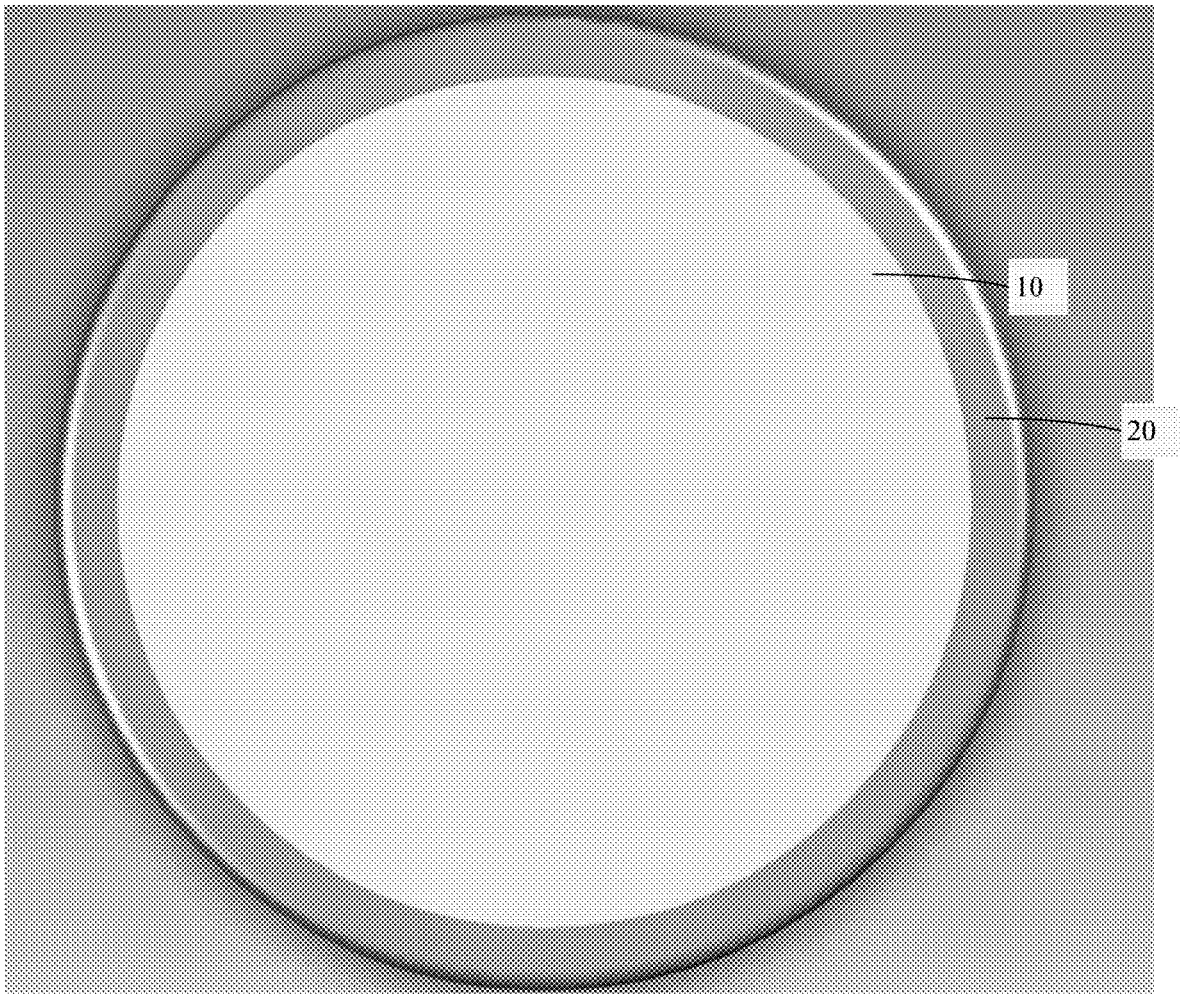
FIG. 17 illustrates a top view of the apparatus for winding cables according to an example implementation.

FIG. 17 illustrates a top view of the apparatus for winding cables, including cover 10 and top portion 20, according to an example implementation.

As can be seen, the cover portion may be snap-fit into the top portion, and the top portion may be attached, such as threadably using one or more connection elements, to the base portion.

The example implementations generate an ordered appearance in the areas in which different devices are plugged in. At the same time, each of the cables for each of the electronic devices may be exposed such that the cables are organized in an independent and separable manner, without requiring the untangling or decoupling from other cables.

According to one present example implementation, the product may be affixed to a side or rear surface of a television, so as to organize the cables of the television and any adjacent electronic devices having cables, independent of the number of pieces or devices that are connected to the entertainment system. This example implementation may be located in the television environment of homes, restaurants, offices or any other installation where organization of a plurality of cables is required. For example, but not by way of limitation, it is possible to roll up separately all the devices that have an electrical connection, and thus have the cables of each one identified in order.

The example implementations may also be installed with respect to commercial, industrial, residential or other area of furniture or the like, such as bureaus. Accordingly, the cables of the lamps, telephone, cell phones, etc. may be organized independent of their respective sizes, and may be accessible independently of one another. Further, the cables are not seen as hanging below the furniture and to be able to have an organization of each cable separately. This aspect may have the benefit of permitted ease of moving, cleaning, etc. Additionally, there may be further benefits for users having pets, children, or moving objects (e.g., robot vacuum cleaner), to avoid injury or property damage.

According to additional example implementations, the apparatus may be scaled to a substantially larger size. Thus, the apparatus of the example implementations may be positioned adjacent to or behind any type of electrical appliance, as well as washing centers (e.g., laundromat), and with this avoid cables are hanging and in disorder. Further, damage from rodents may also be limited, due to the limited access to the cables.

Other aspects may involve use in a non-electronic aspect. For example, but not by way of limitation, the example implementations may be used to roll or wind a hose, such as a fuel hose, garden watering hose, or the like. A mixture of various types of hoses may also be stored, such as at industrial facilities, airports, factories or the like. In other words, segments such as industrial, commercial facilities, and/or communication infrastructure can be covered, to organize and avoid a risk that may cause the disorder of a cable or cables, which are loose.

Although a few example implementations have been shown and described, these example implementations are provided to convey the subject matter described herein to people who are familiar with this field. It should be understood that the subject matter described herein may be implemented in various forms without being limited to the described example implementations. The subject matter described herein can be practiced without those specifically defined or described matters or with other or different elements or matters not described. It will be appreciated by those familiar with this field that changes may be made in these example implementations without departing from the subject matter described herein as defined in the appended claims and their equivalents.

What is claimed is:

1. An apparatus for winding at least one cable, the apparatus comprising:

a cover;

a top portion attached to the cover; and a base attached to the top portion, wherein a surface of the base is configured to be attached to a stationary object, wherein the top portion comprises a cylindrical body that extends from a bottom surface of the top portion toward the cover and a sloped surface configured to receive the at least one cable, such that the at least one cable remains detangled and is externally invisible when is fully wound around the sloped surface, and wherein the sloped surface comprises a plurality of protrusions each protruding in a radial direction of the cylindrical body and from a side surface of the cylindrical body to a bottom surface of the cover.

2. The apparatus according to claim 1, wherein the surface of the base is configured to be fixably attached to the stationary object.

3. The apparatus according to claim 1, wherein the surface of the base is configured to be detachably attached to the stationary object.

4. The apparatus according to claim 1, wherein the top portion is detachably attached to the cover.

5. The apparatus according to claim 1, wherein the cover and top portion are a unitary piece that attaches to the base.

6. The apparatus according to claim 1, wherein the base includes a cylindrical enclosure that extends from a bottom surface of the base, the top portion rotating around an axial direction of the cylindrical enclosure to change a gap between a top surface of the cylindrical enclosure and a bottom surface of the cover.

7. The apparatus according to claim 6, wherein the at least one cable passes through the gap to wind around the sloped surface.

8. The apparatus according to claim 7, wherein, after the at least one cable is wound around the sloped surface, the at least one cable exits the apparatus through the gap.

9. The apparatus according to claim 1, wherein one of the top portion and the base includes a female connector configured to engage with a male connector provided in an other one of the top portion and the base.

10. The apparatus according to claim 9, wherein, by engaging the female connector to the male connector, a gap between a top surface of the base and a bottom surface of the cover changes to provide a space for the at least one cable to pass through the gap for winding around the sloped surface.

11. The apparatus according to claim 9, wherein the male connector comprises a bolt and the female connector comprises a nut that engages with the bolt by rotating the top portion around an axial direction of the bolt to change a gap between a top surface of the base and a bottom surface of the cover to provide a space for the at least one cable to pass through the gap for winding around the sloped surface.

12. The apparatus according to claim 1, wherein an inner surface of said each of the protrusions is attached to the cylindrical body and the bottom surface of the cover.

13. The apparatus according to claim 12, wherein an outer surface of said each of the protrusions is configured to contact the at least one cable while the at least one cable winds around the sloped surface.

14. The apparatus according to claim 13, wherein a pair of bumps protrudes in the radial direction of cylindrical body and from the side surface of the cylindrical body.

15. The apparatus according to claim 14, wherein, in the radial direction of cylindrical body, the pair of bumps protrudes more than each of the protrusions.

16. The apparatus according to claim 15, wherein an inner surface of each of the bumps is attached to the cylindrical body and the bottom surface of the cover.

17. The apparatus according to claim 16, wherein an outer surface of said each of the protrusions is configured to contact the at least one cable while the at least one cable winds around the sloped surface.

18. A stationary object on which at least one cable passes through, the stationary object comprising:

an apparatus for winding the at least one cable; and a platform on which the apparatus is attached, wherein the apparatus comprises:

a cover;

a top portion attached to the cover; and a base attached to the top portion, wherein a surface of the base is configured to be attached to the platform, wherein the top portion comprises a cylindrical body that extends from a bottom surface of the top portion toward the cover and a sloped surface configured to receive the at least one cable, such that at least one cable remains detangled and is externally invisible when is fully wound around the sloped surface, and wherein the sloped surface comprises a plurality of protrusions each protruding in a radial direction of the cylindrical body and from a side surface of the cylindrical body to a bottom surface of the cover.

* * * * *